US007185452B2

(12) United States Patent
Brown

(10) Patent No.: US 7,185,452 B2
(45) Date of Patent: Mar. 6, 2007

(54) FINGERNAIL HOLDER FOR FINGERNAIL POLISH BOTTLE

(76) Inventor: Shahnaz Mir Brown, 2010 Durante Blvd., Suite 104, Del Mar, CA (US) 92014

( * ) Notice: Subject to any disclaimer, the term of this patent is extended or adjusted under 35 U.S.C. 154(b) by 91 days.

(21) Appl. No.: 10/310,447

(22) Filed: Dec. 5, 2002

(65) Prior Publication Data

US 2004/0107609 A1 Jun. 10, 2004

(51) Int. Cl.
*G09F 3/00* (2006.01)

(52) U.S. Cl. ..... 40/310; 40/312; 434/100; 206/457

(58) Field of Classification Search ..... 40/311, 40/312; 248/223.41, 230.7, 231.81, 229.6
See application file for complete search history.

(56) References Cited

U.S. PATENT DOCUMENTS 2,195,495 A * 4/1940 Popp ..... 434/100
3,322,381 A * 5/1967 Bubb ..... 248/121
4,320,832 A * 3/1982 Edstrom ..... 206/228
4,373,632 A * 2/1983 VanZandt ..... 206/457
4,842,332 A * 6/1989 Conner et al. ..... 297/214
4,903,838 A * 2/1990 Broers et al. ..... 206/459.5
4,951,596 A * 8/1990 Wallace, Jr. ..... 116/321
5,743,414 A * 4/1998 Baudino ..... 211/69.1

* cited by examiner

*Primary Examiner*—Cassandra Davis
(74) *Attorney, Agent, or Firm*—John R. Ross; John R. Ross, III

(57) ABSTRACT

A product and method for the display of fingernail polish dried on an artificial fingernail which in turn is attached to a polish bottle containing the polish. In a preferred embodiment a fingernail holder is connected to a bottle cap of the fingernail polish bottle. The fingernail holder made from a rubbery substance has a nail grasping section for grasping the artificial fingernail and a cap grasping section for grasping the bottle cap. In this embodiment, the nail grasping section utilizes friction and compressive forces to grasp the artificial fingernail and the cap grasping section utilizes friction and compressive forces to grasp the bottle cap.

14 Claims, 3 Drawing Sheets

FINGERNAIL HOLDER FOR FINGERNAIL POLISH BOTTLE

The present invention relates to artificial fingernails and in particular to devices for displaying artificial fingernails.

BACKGROUND OF THE INVENTION

Fingernail polish is very well known. Throughout civilized history women have applied fingernail polish to their fingernails to improve the appearance of the nail. Today, there is a tremendous variety of polish colors of varying quality to choose from. With such a large number of colors to choose from, it is often difficult to pick the best color.

A traditional way to choose a nail polish is to observe the color through the clear polish bottle. FIGS. 1–3 show prior art fingernail polish bottle 8 with bottle cap 7. Bottle 8 is typically made of clear glass. A purchaser can observe the color of the polish by looking at it through the clear glass bottle.

However, observing the color of the polish through the bottle does not necessarily give a true picture of how the polish will look once it is placed on the purchaser's fingernail. For example, the polish will shortly dry after it is placed on the purchaser's fingernail and it will not be as shiny as it appears when wet.

Manufacture of Small Rubbery Parts

Methods for manufacture of small rubbery parts are very well known. A small rubbery part can be molded by inserting a solution into a die having the desired shape. After the solution has been allowed to harden, the die is removed and the small rubbery part is left behind. Also, small rubber parts can be made via an extrusion process. Extrusion is the act of forcing the rubbery material through a die to form a part that has a cross section similar to the opening in the die. The extruded rubbery material can then be sliced with a blade creating a plurality of small rubbery parts. Also, small rubber parts can be die cut from a sheet of rubber having a uniform desired thickness.

What is needed is a better device for displaying to the purchaser how fingernail polish will look after it is placed on a fingernail and allowed to dry.

SUMMARY OF THE INVENTION

The present invention provides a product and method for the display of fingernail polish dried on an artificial fingernail which in turn is attached to a polish bottle containing the polish. In a preferred embodiment a fingernail holder is connected to a bottle cap of the fingernail polish bottle. The fingernail holder made from a rubbery substance has a nail grasping section for grasping the artificial fingernail and a cap grasping section for grasping the bottle cap. In this embodiment, the nail grasping section utilizes friction and compressive forces to grasp the artificial fingernail and the cap grasping section utilizes friction and compressive forces to grasp the bottle cap.

DETAILED DESCRIPTION OF THE PREFERRED EMBODIMENTS

Figure 1:
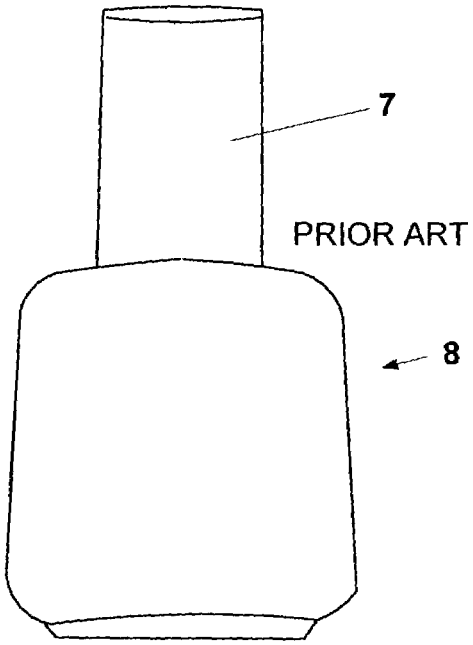
FIGS. 1–3 show a prior art fingernail polish bottle.
Figure 2:
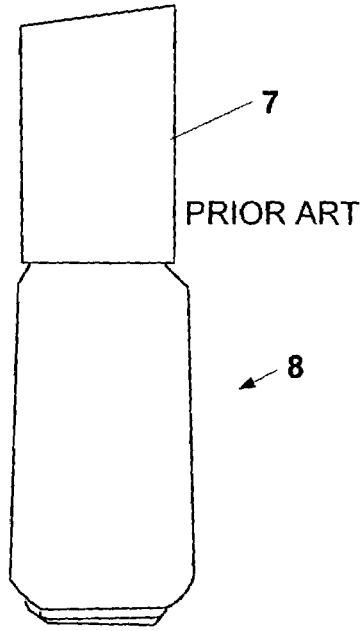
Figure 3:
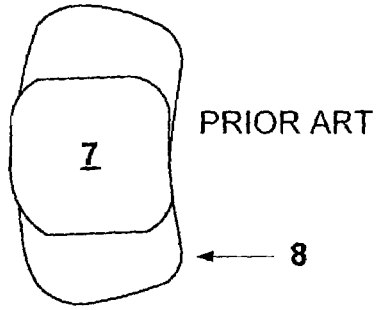
Figure 4A:
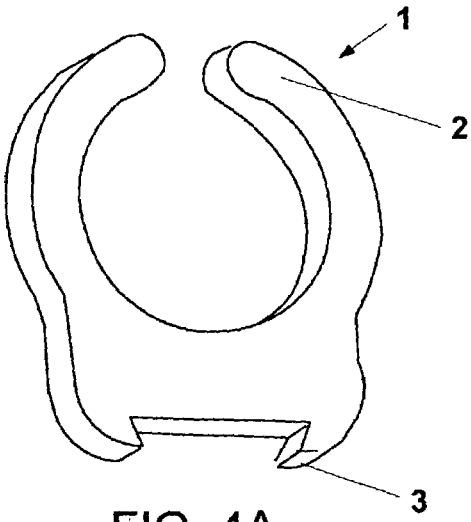
FIG. 4A shows a perspective view of a preferred fingernail holder.
Figure 4B:
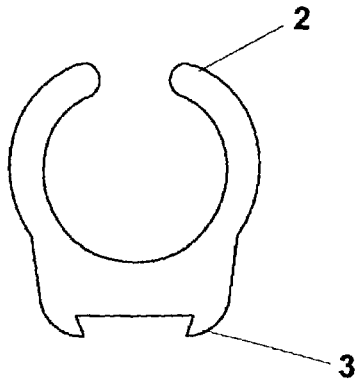
FIG. 4B shows a top view of a preferred fingernail holder.
Figure 5:
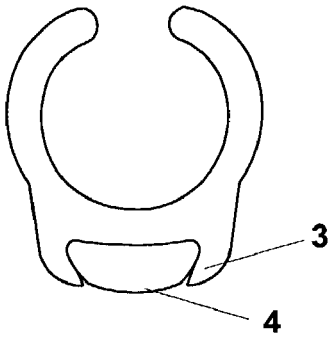
FIGS. 5–9 illustrate how to attach a preferred fingernail holder to a fingernail polish bottle.

A perspective view of a preferred embodiment of the present invention is shown in FIG. 4A and a top view is shown in FIG. 4B. Preferably, fingernail holder 1 is fabricated from synthetic rubber. Fingernail holder 1 has cap grasping section 2 and nail grasping section 3.

Utilization of the Fingernail Holder

FIGS. 5–9 illustrate a first preferred method of utilizing the present invention.

Artificial acrylic fingernail 4 is first painted with fingernail polish from the particular type of fingernail polish contained in fingernail polish bottle 8. Fingernail 4 is then slid into nail grasping section 3. Because fingernail holder 1 is fabricated from a rubbery substance, it will slightly deform as the harder acrylic artificial fingernail 4 is slid into nail grasping section 3. Once fingernail 4 is at the desired position in nail grasping section 3, friction and compressive force will hold it in place.

Figure 7:
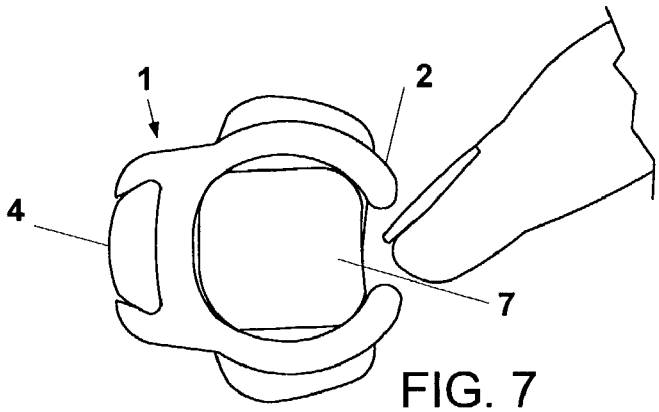
Figure 6:
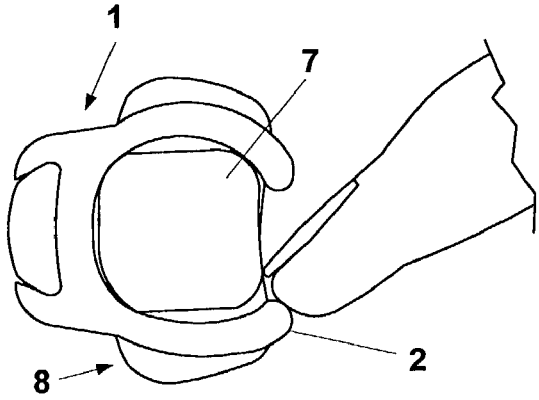

Fingernail holder 1 is then fitted onto polish bottle cap 7 of fingernail polish bottle 8. Cap grasping section 2 is flexible and can be flexed by application of finger force as shown in FIG. 6. FIG. 7 is a top view with fingernail holder 1 in place on bottle cap 7 with artificial fingernail 4 in place for display.

Bottle cap 7 is large enough so that cap grasping section 2 exerts a compressive pressure against bottle cap 7. As stated above, cap grasping section is deformable so that it will flex,-and deform to accommodate bottle cap 7. Friction and compressive force holds grasping section 2 in a steady position around bottle cap 7. The friction and compressive forces can be overcome by applying finger force and sliding fingernail holder 1 up or down as desired.

Figure 8:
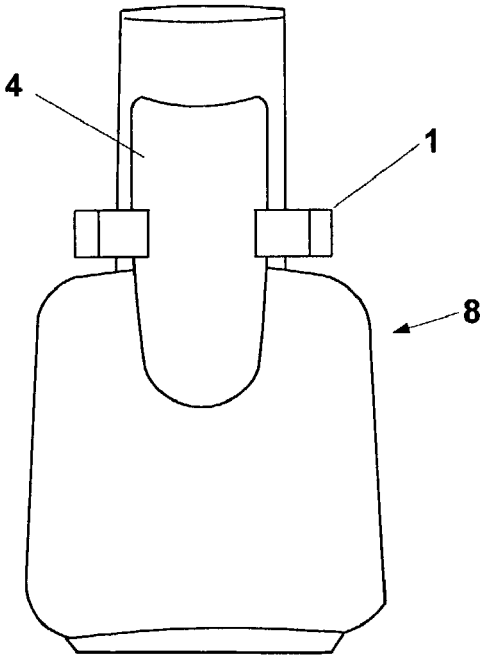
Figure 9:
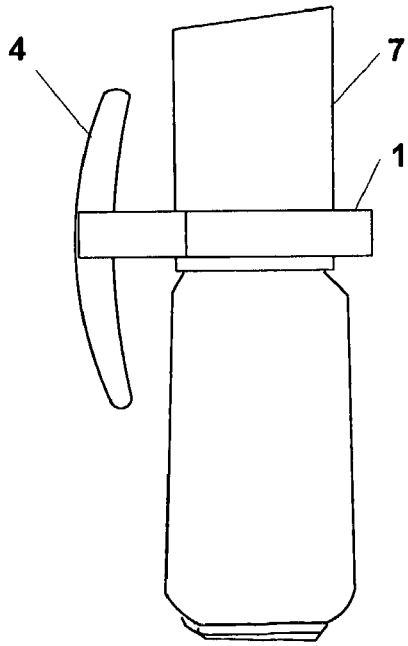

As shown in FIG. 8, finger force is used to slide fingernail holder 1 downward along bottle cap 7. Friction force is holding it steady at the position shown. FIG. 9 shows a side view of the fingernail holder 1 grasping bottle cap 7.

Since fingernail 4 has been painted with the same polish that is in bottle 8, a purchaser can look at the appearance of fingernail 4 and make a relatively accurate determination as to how the polish in bottle 8 will eventually look after it has been painted onto the purchaser's fingernails and dried.

Fingernail holder 1 may be removed from bottle cap 7. Finger force is applied in an upward direction against fingernail holder 1 until it slides off the top of bottle cap 7.

Varying Bottle Cap Styles

Figure 10:
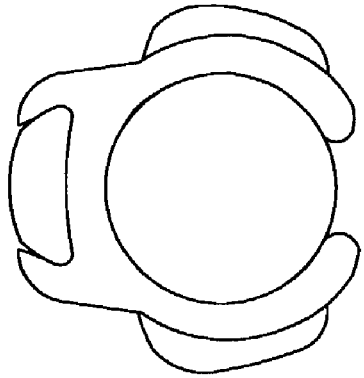
FIG. 10 shows another preferred embodiment of the present invention.
Figure 11:
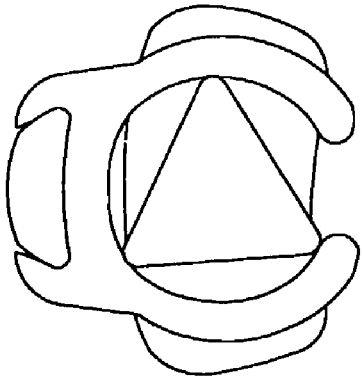
FIG. 11 shows another preferred embodiment of the present invention.

Fingernail holder 1 can be placed on bottle caps of a variety of sizes and styles. For example, FIG. 10 shows bottle cap 20 that is round in shape. Also, FIG. 11 shows bottle cap 21 that has a triangular shape. In each case, friction and compressive forces hold fingernail holder 1 against the bottle cap.

Second Preferred Embodiment

Figure 12:
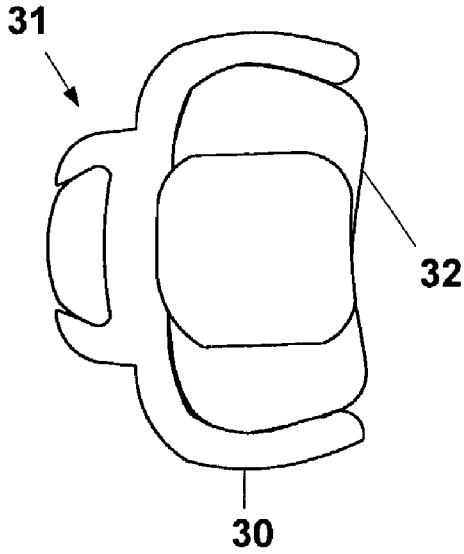
FIG. 12 shows another preferred embodiment of the present invention.

In a second preferred embodiment as shown in FIG. 12, cap grasping section 2 of the first preferred embodiment has been replaced with bottle grasping section 30. Fingernail holder 31 therefore will remain attached to bottle 32 even after bottle cap 33 has been removed.

Third Preferred Embodiment

Figure 13:
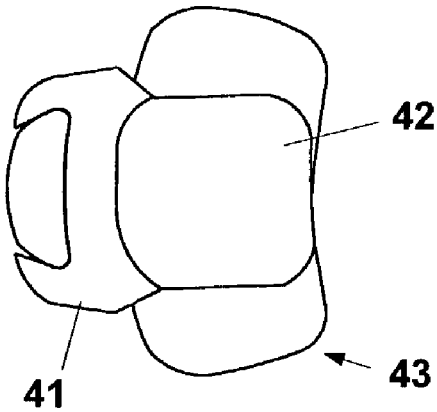
FIG. 13 shows another preferred embodiment of the present invention.

In the third preferred embodiment as shown in FIG. 13, nail grasping section 41 is bonded to bottle cap 42 and may be sold along with the bottle of polish. A preferred method of bonding is achieved by gluing nail grasping section 41 to bottle cap 42.

Manufacture of the Fingernail Holder

Fingernail holder 1 can be manufactured utilizing a variety of methods. In one preferred embodiment, fingernail holder 1 (FIGS. 4A–4B) is fabricated from a rubbery substance that has been molded after a solution has been inserted into a die having the preferred shape and allowed to harden. In another preferred embodiment, fingernail holder 1 is fabricated from a rubbery substance by utilization of an extrusion process. In another preferred embodiment fingernail holder 1 is die cut from a sheet of a rubbery substance.

While the above description contains many specifications, the reader should not construe these as limitations on the scope of the invention, but merely as exemplifications of preferred embodiments thereof. Those skilled in the art will envision many other possible variations are within its scope. For example, although it was stated that fingernail holder 1 is preferably fabricated from synthetic rubber, it can also be fabricated from a number of other rubbery substances such as natural rubber or flexible plastics. Accordingly the reader is requested to determine the scope of the invention by the appended claims and their legal equivalents, and not by the examples which have been given.

What is claimed is:

1. A polished fingernail display device comprising a fingernail holder comprised of a rubbery substance and further comprising:

a. a nail grasping section utilizing friction and compressive forces for grasping the sides of an artificial fingernail, and b. a polish container grasping section for gasping a fingernail polish container or a cap of a fingernail polish container, wherein said display device is attached to said fingernail polish container or said cap of said fingernail polish container and an artificial fingernail painted with fingernail polish representative of polish contained within said fingernail polish container is grasped within said nail grasping section.

2. The display device as in claim 1, wherein said polish container grasping section utilizes friction and compressive forces to grasp said fingernail polish container or said cap of said fingernail polish container.

3. The display device as in claim 1, wherein said rubbery substance is natural rubber.

4. The display device as in claim 1, wherein said rubbery substance is synthetic rubber.

5. A polished fingernail display device comprising a fingernail holder means comprised of a rubbery substance and further comprising:

a. a means for utilizing friction and compressive forces for grasping the sides of an artificial fingernail, and b. a means for grasping a fingernail polish container or a cap of a fingernail polish container, wherein said display device is attached to said fingernail polish container or said cap of said fingernail polish container and an artificial fingernail painted with fingernail polish representative of polish contained within said fingernail polish container is grasped within a means for grasping an artificial fingernail.

6. The display device as in claim 5, wherein said means for grasping a fingernail polish container or a cap of a fingernail polish container utilizes friction and compressive forces to grasp said fingernail polish container or said cap of said fingernail polish container.

7. The display device as in claim 5, wherein said rubbery substance is natural rubber.

8. The display device as in claim 5, wherein said rubbery substance is synthetic rubber.

9. A polished fingernail display device comprising:

a. a nail grasping section utilizing friction and compressive forces for grasping the sides of an artificial fingernail, and b. a polish container grasping section for grasping a fingernail polish container or a cap of a fingernail polish container, wherein said display device is attached to said fingernail polish container or said cap of said fingernail polish container and an artificial fingernail painted with fingernail polish representative of polish contained within said fingernail polish container is grasped within said nail grasping section.

10. The display device as in claim 9, wherein said nail grasping section is comprised of a rubbery substance.

11. The display device as in claim 9, wherein said polish container grasping section is comprised of a rubbery substance.

12. The display device as in claim 9, wherein said nail grasping section and said polish container grasping section are each comprised of a rubbery substance.

13. The display device as in claim 9, wherein said artificial fingernail is shaped like an actual fingernail and is capable of being applied to said actual fingernail via an adhesive.

14. A polished fingernail display device comprising:

a. a nail grasping section utilizing friction and compressive forces for grasping an artificial fingernail, and b. a polish container grasping section for grasping a fingernail polish container or a cap of a financial polish container, wherein said display device is attached to said fingernail polish container or said cap of said fingernail polish container and an artificial fingernail painted with fingernail polish representative of polish contained within said fingernail polish container is grasped within said nail grasping section, wherein said friction and compressive forces are utilized to grasp the sides of said artificial fingernail.

* * * * *